US008051706B2

(12) United States Patent
DiFoggio

(10) Patent No.: US 8,051,706 B2
(45) Date of Patent: Nov. 8, 2011

(54) WIDE LIQUID TEMPERATURE RANGE FLUIDS FOR PRESSURE BALANCING IN LOGGING TOOLS

(75) Inventor: Rocco DiFoggio, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 529 days.

(21) Appl. No.: 12/333,401

(22) Filed: Dec. 12, 2008

(65) Prior Publication Data

US 2010/0147064 A1 Jun. 17, 2010

(51) Int. Cl.
*E21B 47/06* (2006.01)

(52) U.S. Cl. ..... 73/152.51

(58) Field of Classification Search ..... 73/152.01, 73/152.02, 152.18, 152.51, 701
See application file for complete search history.

(56) References Cited

U.S. PATENT DOCUMENTS

| | | | | |
|---|---|---|---|---|
| 3,638,496 | A * | 2/1972 | King | 73/728 |
| 3,656,348 | A * | 4/1972 | Bertrand | 73/701 |
| 3,788,125 | A * | 1/1974 | Kirschstein et al. | 73/32 R |
| 4,252,015 | A * | 2/1981 | Harbon et al. | 73/152.51 |
| 5,138,876 | A | 8/1992 | Moore et al. | |
| 5,253,519 | A | 10/1993 | Muschotti et al. | |
| 5,949,017 | A | 9/1999 | Oommen et al. | |
| 6,037,537 | A | 3/2000 | Mcshane et al. | |
| 6,184,459 | B1 | 2/2001 | McShane et al. | |
| 6,352,655 | B1 | 3/2002 | McShane et al. | |
| 6,398,986 | B1 | 6/2002 | McShane et al. | |
| 6,474,151 | B1 * | 11/2002 | Martin et al. | 73/152.16 |
| 6,485,659 | B1 | 11/2002 | Goedde et al. | |
| RE38,129 | E | 6/2003 | Kleinberg | |
| 6,613,250 | B2 | 9/2003 | McShane et al. | |
| 6,726,857 | B2 | 4/2004 | Goedde et al. | |
| 6,905,638 | B2 | 6/2005 | Corkran et al. | |
| 6,926,080 | B2 | 8/2005 | Khomynets et al. | |
| 2004/0084180 | A1 | 5/2004 | Shah et al. | |

OTHER PUBLICATIONS

Notification of Transmittal of the International Search Report and the Written Opinion of the International Searching Authority; PCT/US2009/067705; Mailed May 24, 2010.
Hawaii Electric Light Company (HELCO) rewards ABB with BIOTEMP retro-fill order, [online]; retrieved on Mar. 12, 2008; retrieved form the Internet http://inside.abb/com/global/seitp/seitp202.nsf/0/2A5F924E84A0CC6A85256F4000FE6C....
CLEARCO; Pure Silicone Fluid 1.5cst Low Temperature Bath Fluid, [online]; retrieved from the Internet www.clearcoproducts.com, Feb. 2009.
ENVIROTEMP FR3 Fluid, Bulletin 00092 Product Information Jun. 2001.
Prasun K. Mandal, et al. "Solvation dynamics in room temperature ionic liquids: Dynamic Stokes shift studies of fluorescence of dipolar molecules". Current Science, vol. 90, No. 3, Feb. 10, 2006.
BIOTEMP Material Safety Data Sheet. pp. 1-4. Feb. 16, 2006.
BIOTEMP, Biodegradable Dielectric Insulating Fluid for Distribution and Power Transformers. 2nd Edition. Feb. 27, 2008.
FR3, Material Safety Data Sheet. pp. 1-4. Bulletin 98082, May 2007.

(Continued)

*Primary Examiner* — John Fitzgerald
(74) *Attorney, Agent, or Firm* — Cantor Colburn LLP

(57) ABSTRACT

An apparatus for performing a measurement in a borehole penetrating the earth, the apparatus including: a logging tool; an enclosed instrument cell disposed at the logging tool, the instrument cell being configured to perform the measurement; and a fill liquid disposed in the cell wherein the fill liquid remains in a liquid state and is nonflammable from 20° C. to 300° C.

20 Claims, 3 Drawing Sheets

OTHER PUBLICATIONS

Certified Environmental Technology, Technology Transfer Advisory. Envirotemp FR3 Vegetable Oil-Based Insulating Dielectric Fluid. Internet at http://www.dtsc.ca.gov/TechnologyDevelopment/TechCert/company index.cfm. Revised on Nov. 2, 2005.

BIOTEMP, Biodegradable Dielectric Insulating Fluid. ABB Inc. Descriptive Bulletin 47-1050 Revised Jan. 2002. The Musselman Group, Roanoke, VA. www.abb.com/transformers.

Ed Walsh, et al. Introducing the 'green' transformer. Biodegradable insulating fluid based on vegetable oils. ABB Review Feb. 2000 p. 85.

J.C. Mendes, "Oiled and ready to go". Advanced application of ABB BIOTEMP vegetable oil in a HV power transformer. ABB Review Mar. 2007. pp. 53-57.

Dr. Stephane A. Page. BIOTTEMP-ABB Sensible Solution. Short Introduction. ABB BU Transformers Apr. 23, 2008.

Dr. Stephane A. Page. BIOTTEMP-ABB Sensible Solution. Fluid Properties and Considerations. ABB BU Transformers Apr. 23, 2008.

Accelerating Ionic Liquid Commercialization, Research Needs to Advance New Technology. p. 1-27. Jun. 2004.

Dynalene Inc., Open Bath Fluids. [online]; retrieved on Feb. 19, 2009. retrieved from the Internet http:..www.dynalene.com/products/otb.asp.

Imperial Oil. Product Data Sheet for Univis Extra Super Multi-Grade Hydraulic Oil. Oct. 2003.

Alkane, [online]; [retrieved on Feb. 19, 2009]; retrieved from the Internet http://en.wikipedia.org/wiki/Alkane.

Imperial Oil. Product Data Sheet for Univis N, All Weather Anti-Wear Hydraulic Oils for Mobile and Industrial Equipment. Jan. 2007.

Peter Nockemann, et al. "Choline Saccharinate and Choline Acesulfamate: Ionic Liquids with Low Toxicities". J. Phys. Chem. B 2007, 111, 5254-5263.

Lance R. Lewand "Natural Ester Dielectric Liquids". Chemist's Perspective, Fall 2004. pp. 1-4.

* cited by examiner

Side View

Front View

Side View

WIDE LIQUID TEMPERATURE RANGE FLUIDS FOR PRESSURE BALANCING IN LOGGING TOOLS

BACKGROUND OF THE INVENTION

1. Field of the Invention

The present invention relates to apparatus and method for performing measurements of the earth from within a borehole.

2. Description of the Related Art

Exploration for energy such as hydrocarbons or geothermal sources generally requires drilling a borehole into the earth. The borehole can be used to gain access to depths of the earth for performing measurements related to the exploration for energy.

Well logging is a technique used to perform the measurements from the borehole. In well logging, a logging tool is conveyed through the borehole. The logging tool includes those components used to perform the measurements. In one embodiment, a wireline is used to support the logging tool and to transmit the measurements to the surface of the earth for processing and recording.

Many types of measurements can be performed from within the borehole. Some of these measurements use an enclosed instrument cell as a component of the logging tool. The enclosed instrument cell generally has a diaphragm that provides an interface with the environment external to the cell. For example, an enclosed instrument cell can be configured to measure the pressure exerted on the diaphragm. The pressure exerted on the diaphragm is transferred to components internal to the cell, which measure the pressure.

When the logging tool is disposed deep in the borehole, the tool can be exposed to high pressure and high temperature. For example, pressure in the borehole can exceed 10,000 psi and the temperature can exceed 300° C. In general, the enclosed instrument cell is filled with a liquid to equalize the pressure internal to the cell to the external pressure to prevent the cell from being crushed at the high pressure. However, the high temperature can adversely affect the liquid causing the instrument cell to malfunction.

Therefore, what are needed are techniques to measure properties of the earth from within a borehole at high pressures and high temperatures.

BRIEF SUMMARY OF THE INVENTION

Disclosed is an apparatus for performing a measurement in a borehole penetrating the earth, the apparatus including: a logging tool; an enclosed instrument cell disposed at the logging tool, the instrument cell being configured to perform the measurement; and a fill liquid disposed in the cell wherein the fill liquid remains in a liquid state and is nonflammable from 20° C. to 300° C.

Also disclosed is a method for performing a measurement in a borehole penetrating the earth, the method including: conveying a logging tool through the borehole, the logging tool having an enclosed instrument cell configured to perform the measurement wherein a fill liquid that remains in a liquid state and is nonflammable from 20° C. to 300° C. is disposed in the cell; and performing the measurement with the instrument cell.

Further disclosed is an apparatus for performing a measurement, the apparatus including: an enclosed instrument cell configured to perform the measurement; and a fill liquid disposed in the cell wherein the fill liquid remains in a liquid state and is nonflammable from 20° C. to 300° C.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION OF THE INVENTION

Figure 1:
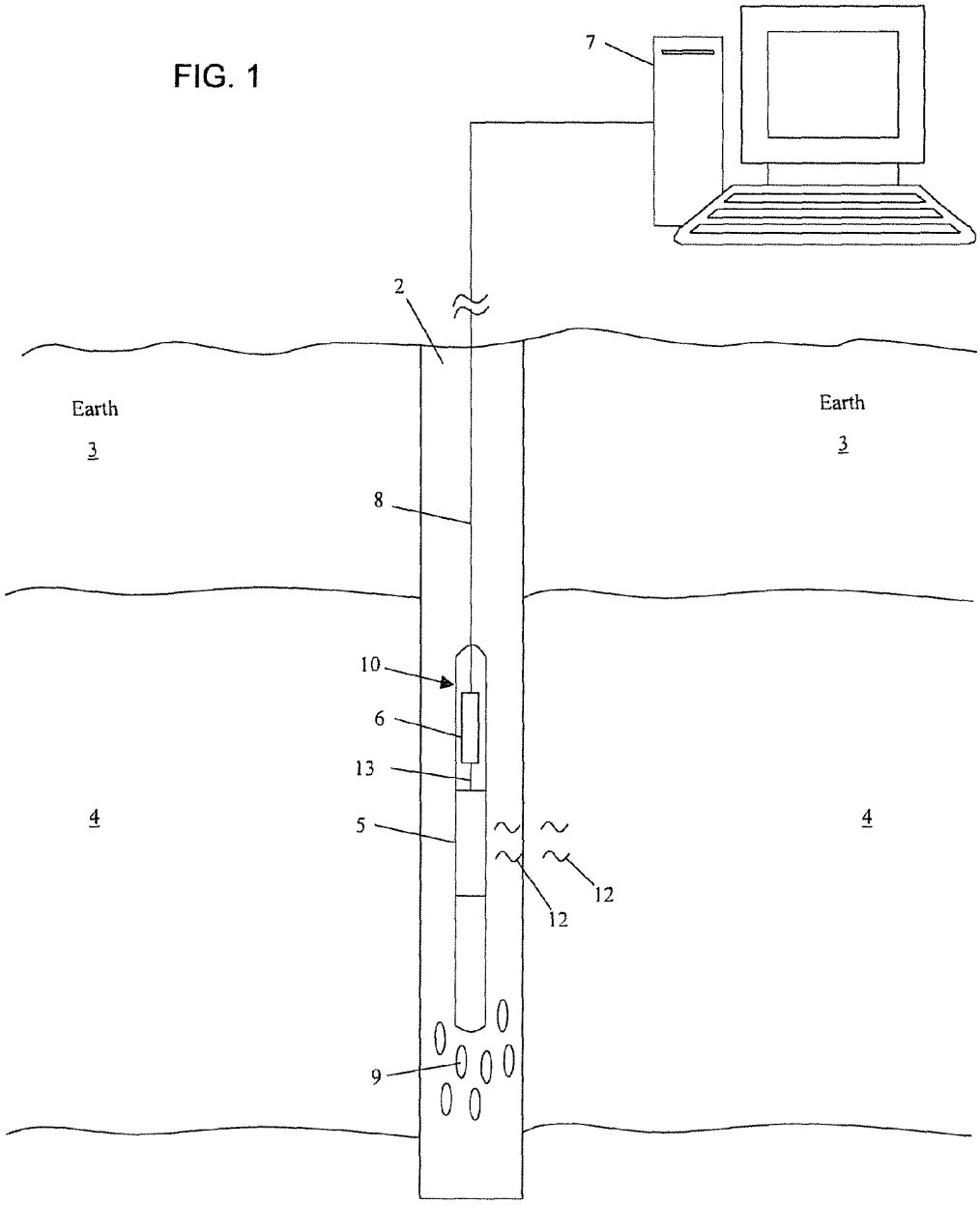
FIG. 1 illustrates an exemplary embodiment of a logging tool disposed in a borehole penetrating the earth.

Disclosed are techniques for measuring properties of the earth using an enclosed instrument cell. In particular, the techniques can be used at high pressures and high temperatures in a borehole penetrating the earth. The techniques, which include apparatus and method, call for filling the enclosed instrument cell with a fill fluid that remains a liquid over a wide range of temperatures. The fill fluid or fill liquid balances the internal pressure of the instrument cell with the external pressure.

Because temperatures in the borehole can reach 300° C. in some applications, the selected fill fluid must remain in a liquid state at 300° C.

Calibration and testing of the enclosed instrument cell is generally performed in a laboratory at room temperatures as low as about 20° C. Thus, the fill fluid must be in a liquid state in the temperature range of 20-300° C.

Other factors are also important in selecting the fill liquid. One factor is having a flash point above the highest temperature in the temperature range to prevent a fire from occurring should the fill liquid leak out of the instrument cell. Thus, the flash point of the fill liquid must be greater than 300° C. A fill liquid having a flash point greater than 300° C. is considered nonflammable in the temperature range of 20-300° C.

Another important factor in selecting the fill fluid is having a pour point low enough so that the fill fluid can easily be poured into the instrument cell. A pour point too high can cause problems in fabricating the instrument cell. Thus, the pour point should be below 20° C. to allow fabricating the instrument cell at room temperature.

Still another important factor in selecting the fill fluid is having a viscosity low enough to provide for proper operation of the instrument cell. For example, an instrument cell may be used as an acoustic transducer used for imaging features of the earth. The diaphragm of the instrument cell is required to move to either emit or receive acoustic waves. The viscosity of the fill liquid can affect movement of the diaphragm and, therefore, can affect proper operation of the acoustic transducer. Also, if the instrument cell contains an acoustic transducer, and the liquid solidified at laboratory temperatures, then the transducer would not simply be transmitting compressional waves as intended but shear waves as well.

Traditional instrument cells have used petroleum-based liquids such as mineral oil for the fill liquid. The main disadvantage to using petroleum-based liquids is that the petroleum-based liquids have a flash point of less than 300° C., generally no higher than 242° C. Therefore, a heat test of the cell performed in the laboratory in an air oven could lead to a fire.

Silicone oil has also been used as a fill liquid in traditional instrument cells. However, silicone oil does not remain in a liquid state from 20° C. to 300° C. Thus, the instrument cell will not function properly at 300° C. Another disadvantage of silicone oil is that silicone oil, like petroleum-based liquids, has a flash point less than 300° C.

Disclosed herein are two types of fill liquids that remain in a liquid state for the desired temperature range of 20-300° C. In addition, the disclosed fill liquids are nonflammable or have flash points greater than 300° C. and pour points below 20° C. The first type is a dielectric or nonconductive liquid based on an ester (natural or synthetic). The second type is a conductive liquid based on a room temperature ionic liquid (RTIL). Each type of fill liquid may be used depending on the application within the enclosed instrument cell. For example, the dielectric fill liquid may be used in an instrument cell having electronic components that need to be insulated from each other. The conductive fill liquid can be used in an instrument cell in which electrical power or an electrical signal is conducted along a via or pathway containing the conductive liquid. For example, a disk-shaped acoustic transducer can be supported circumferentially by an electrically non-conducting membrane that separates an ionic liquid above it from an ionic liquid below it so that the two ionic liquids are electrically isolated from each other. The top face of the transducer is in electrical contact with the upper ionic liquid and the bottom face is in electrical contact with the lower ionic liquid thus eliminating the need for a high temperature solder or conductive epoxy to make electrical contact to these faces.

The natural ester-based fill liquid is produced from a vegetable oil. The vegetable oil is generally a high oleic vegetable oil. The vegetable oil in turn is obtained from oil bearing vegetable seeds. In general, a refining process includes: (1) extracting crude vegetable oil from the vegetable seeds, (2) filtering the crude vegetable oil to remove materials other than the vegetable oil, (3) bleaching the filtered crude vegetable oil as part of a neutralization process and to remove polar compounds, and (4) deodorizing the bleached vegetable oil. The synthetic ester-based fill liquid is produced from chemicals chosen to yield properties the same as or similar to the natural ester.

Natural ester based liquids are commercially available. One example is BIOTEMP® available from ABB Inc. of South Boston, Va. BIOTEMP® is made mostly of mono-unsaturated high oleic acid triglyceride vegetable oils. Some examples of plants producing the high oleic vegetable oils used in BIOTEMP® are sunflower, safflower and rapeseed (canola). Another example of the natural ester based liquid is Envirotemp® FR3™ available from Cooper Power Systems of Waukesha, Wis. Envirotemp® FR3™ is triglyceride fatty acid natural ester containing a mixture of saturated and unsaturated fatty acids. Vegetable oils used in Envirotemp® FR3™ may be obtained from the seeds of soya, sunflower and rapeseed.

The RTIL conductive fill liquid is an organic salt made up entirely of ions. RTILs have a wide range of temperatures in the liquid state, negligible vapor pressure, high thermal stability, high conductivity, low moisture sensitivity, non-flammability and low or non-toxicity. It is possible to obtain an RTIL by replacing the chloride anions in choline chloride (2-hydroxyethyltrimethyl ammonium chloride or vitamin B4) with other counterions. Non-limiting examples of two RTILs with low toxicity are choline saccharinate ($[Chol]^+[Sac]^-$) and choline acesulfamate ($[Chol]^+[Ace]$). Because RTILs are an alternative for volatile organic solvents, care must be taken in selecting materials for the instrument cell that are compatible with the RTILs.

Certain definitions are now introduced for convenience. The term "cell" relates to an enclosed structure. The enclosed structure is sealed to prevent a liquid disposed internal to the structure from leaking out or external liquids from leaking in. As used herein, the cell can be an instrument cell that performs measurements or the cell can be used to house other types of non-instrument components. In either case, the cell can be filled with a liquid to prevent the cell from being deformed or crushed at high pressures. The term "fill liquid" relates to a liquid that is used to fill a cell. For example, the cell can contain a sensitive pressure sensor, such as a quartz resonator that can easily be fouled by direct exposure to borehole fluids, or the cell can contain an acoustic transducer for making acoustic measurements, or the cell can contain a chemical sensor. For a chemical sensor application in which the chemical to be analyzed diffuses across a membrane, it may be preferable to use ionic liquids because the ionic liquids are excellent solvents for many compounds.

Reference may now be had to FIG. 1. FIG. 1 illustrates an exemplary embodiment of a logging tool 10 disposed in a borehole 2 penetrating the earth 3. The earth 3 includes an earth formation 4, which represents features of interest that may be measured by the logging tool 10. The logging tool 10 is supported by a wireline 8 for logging operations referred to as "wireline logging." The logging tool 10 includes an instrument cell 5 that is used as an interface with the environment external to the instrument cell 5. The instrument cell 5 is configured to perform measurements of the formation 4 or a borehole fluid 9 disposed in the borehole 2 and surrounding the logging instrument 10. The borehole fluid 9 can include fluids such as formation fluids and drilling mud.

Referring to FIG. 1, the logging tool 10 includes an electronic unit 6 coupled to the instrument cell 5 via connection 13. The electronic unit 6 can be used to operate the instrument cell 5 and to receive or process data related to the measurements performed by the instrument cell 5. In one embodiment, the electronic unit 6 stores the data for later retrieval when the logging tool 10 is removed from the borehole 2. In another embodiment, the data is transmitted to the surface of the earth 3 to a processing unit 7. The processing unit 7 can record and process the data either independently or in conjunction with the electronic unit 6.

While the embodiment of FIG. 1 shows the logging tool 10 conveyed through the borehole 2 using the wireline 8, in other embodiments, the logging tool 10 can be conveyed by slickline or coiled tubing or by a drill string for logging-while-drilling (LWD) applications. In the LWD applications, the logging tool 10 may be disposed in a collar attached to the drill string.

Figure 2A:
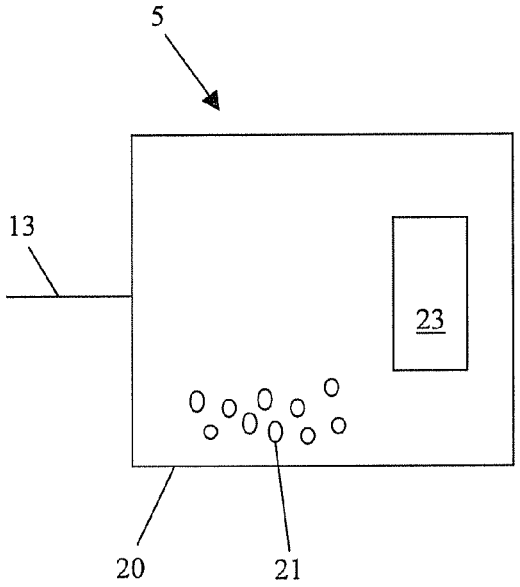
FIGS. 2A and 2B, collectively referred to as FIG. 2, depict aspects of an enclosed instrument cell.
Figure 2B:
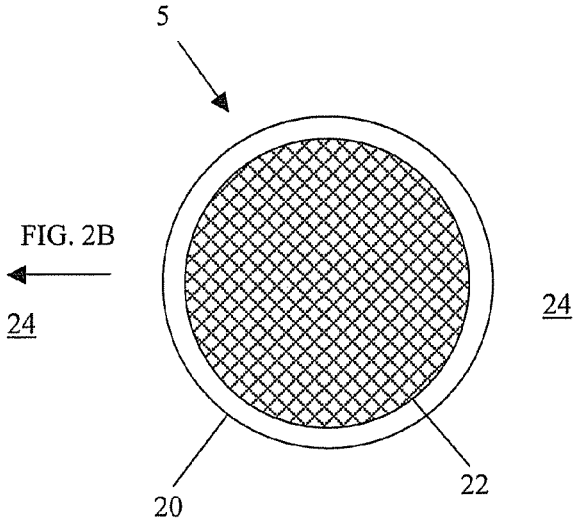

FIG. 2 depicts aspects of an embodiment of the instrument cell 5. Referring to FIG. 2, the instrument cell 5 has a sealed enclosed volume 20. The sealed enclosed volume 20 contains a fill liquid 21. At least one surface of the instrument cell 5 has a flexible diaphragm 22, which transmits external pressure to the fill liquid 22 internal to the cell 5. In this way, the fill liquid 21 equalizes the internal pressure of the volume 20 with the pressure external to the volume 20 to prevent the instrument cell 5 from being deformed or crushed at high external pressures. That is, the diaphragm 22 is used to interface internal instrument component 23 with external environment 24. Non-limiting examples of the external environment 24 include the borehole fluid 9 and the formation 3. When the instrument cell 5 is used as an acoustic transducer, the diaphragm 22 moves to either emit acoustic waves 12 (shown in FIG. 1) into the borehole fluid 9 or receive the acoustic waves 12 from the borehole fluid 9. In one embodiment, the diaphragm 22 shown in FIG. 2 can represent a membrane. In one embodiment, the membrane can serve as a selective barrier to allow certain particles to pass while blocking the other particles. Applications such as chemical analysis can make use of the membrane.

Figure 3:
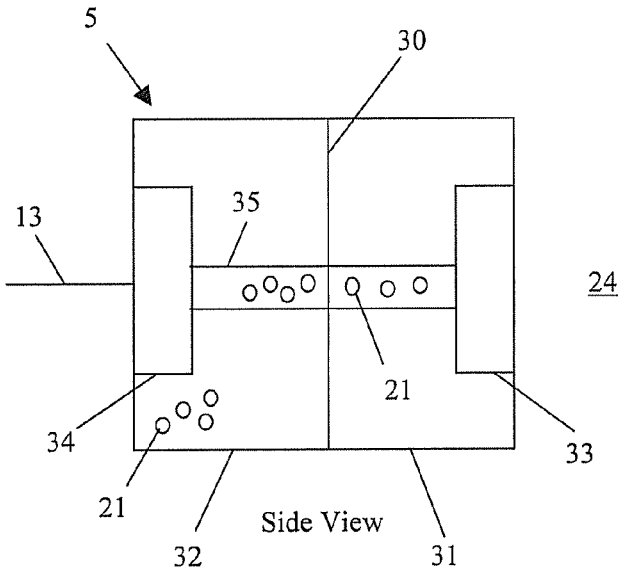
FIG. 3 depicts of another embodiment of the enclosed instrument cell.

FIG. 3 depicts aspects of another embodiment of the instrument cell 5. Referring to FIG. 3A, the instrument cell 5 includes an electrically insulating insulator 30 that insulates a first part 31 of the cell 5 from a second part 32 of the cell 5. In one embodiment, the insulator 30 can be an electrically insulating O-ring. A first electrical component 33 in the first part 31 may be electrically coupled to a second electrical component 34 in the second part 32 by the fill fluid 21 that is conductive. Referring to FIG. 3A, the fill fluid 21 may be disposed in a pathway (or via) 35 coupling the first electrical component 33 to the second electrical component 34.

Figure 4:
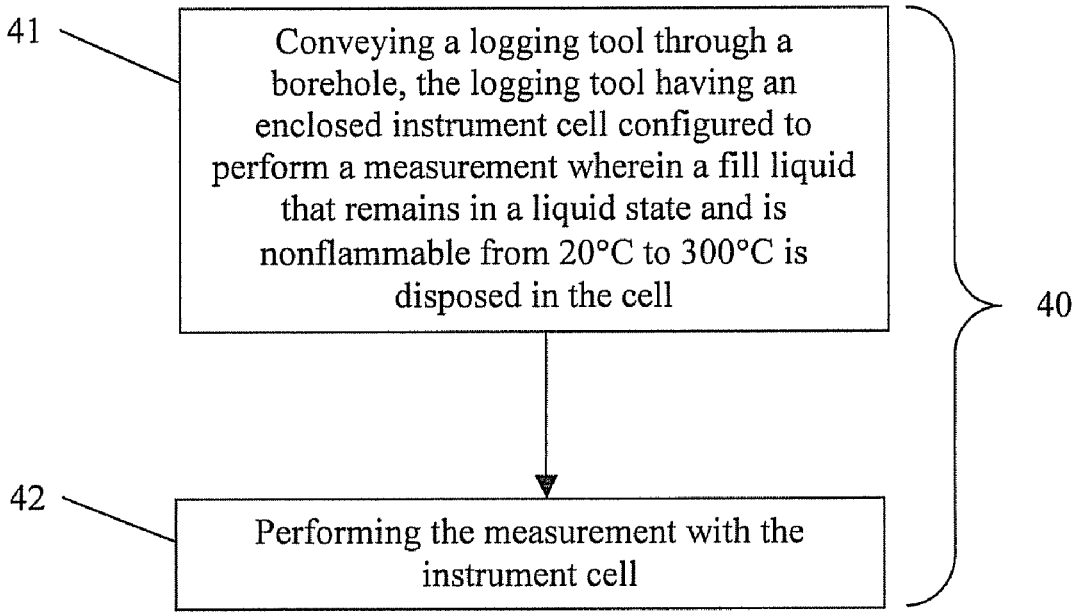
FIG. 4 presents one example of a method for performing a measurement in the borehole.

FIG. 4 presents one example of a method 40 for performing a measurement in the borehole 2 penetrating the earth 3. The method 40 calls for (step 41) conveying the logging tool 10 through the borehole 2, the logging tool 10 having the enclosed instrument cell 5 configured to perform the measurement wherein the fill liquid 21 remains in a liquid state and is nonflammable from 20° C. to 300° C. and is disposed in the cell 5. Further, the method 40 calls for (step 42) performing the measurement with the instrument cell 5.

In support of the teachings herein, various analysis components may be used, including a digital and/or an analog system. For example, the instrument cell 5, the electronic unit 6, and the processing system 7 may include the digital and/or analog system. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a sample line, sample storage, sample chamber, sample exhaust, pump, piston, power supply (e.g., at least one of a generator, a remote supply and a battery), vacuum supply, pressure supply, cooling component, heating component, motive force (such as a translational force, propulsional force or a rotational force), magnet, electromagnet, sensor, electrode, transmitter, receiver, transceiver, antenna, controller, optical unit, electrical unit or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for performing a measurement in a borehole penetrating the earth, the apparatus comprising:

a logging tool;

an enclosed instrument cell disposed at the logging tool, the instrument cell being configured to perform the measurement; and a fill liquid disposed in the cell wherein the fill liquid remains in a liquid state and is nonflammable from 20° C. to 300° C.

2. The apparatus of claim 1, wherein the cell comprises at least one of a diaphragm and a membrane in communication with an external environment.

3. The apparatus as in claim 1, wherein the cell comprises a first part and a second part insulated from each other by an electrical insulator.

4. The apparatus of claim 1, wherein the fill liquid is conductive.

5. The apparatus of claim 4, wherein the fill liquid comprises: a room temperature ionic liquid (RTIL) comprised entirely of ions.

6. The apparatus of claim 5, wherein the conductive fill fluid is disposed in a pathway in the cell.

7. The apparatus of claim 5, wherein the RTIL comprises:

an organic cation containing nitrogen: and an inorganic anion.

8. The apparatus of claim 7, wherein the RTIL is non-toxic.

9. The apparatus of claim 1, wherein the fill liquid is dielectric.

10. The apparatus of claim 9, wherein the fill liquid is biodegradable.

11. The apparatus of claim 10, wherein the fill fluid comprises at least one of a natural ester and a synthetic ester.

12. The apparatus of claim 11, wherein the natural ester is produced from vegetable oil.

13. The apparatus of claim 11, wherein the fill fluid further comprises an additive package comprising at least one of an oxygen inhibitor, a pour point depressant, a copper deactivator, and an antimicrobial agent.

14. A method for performing a measurement in a borehole penetrating the earth, the method comprising:

conveying a logging tool through the borehole, the logging tool comprising an enclosed instrument cell configured to perform the measurement wherein a fill liquid that remains in a liquid state and is nonflammable from 20° C. to 300° C. is disposed in the cell; and performing the measurement with the instrument cell.

15. The method of claim 14, further comprising transmitting at least one of electrical energy and an electrical signal through the fill liquid, the fill liquid being conductive.

16. The method of claim 14, further comprising communicating a property external to the cell to a component internal to the cell.

17. The method of claim 16, wherein the property comprises at least one of pressure, temperature, force, acceleration, acoustic energy, electromagnetic energy, optical property, and chemical property.

18. The method of claim 16, wherein the property is communicated via at least one of a diaphragm and a membrane.

19. An apparatus for performing a measurement, the apparatus comprising:

an enclosed instrument cell configured to perform the measurement; and a fill liquid disposed in the cell wherein the fill liquid remains in a liquid state and is nonflammable from 20° C. to 300° C.

20. The apparatus of claim 19, wherein the fill liquid comprises at least one of a natural ester, a synthetic ester, and a room temperature ionic liquid.

* * * * *